US008181742B1

(12) United States Patent
Ranese et al.

(10) Patent No.: US 8,181,742 B1
(45) Date of Patent: May 22, 2012

(54) SAFETY JACK PLATE

(76) Inventors: Thomas F. Ranese, Berkley Heights, NJ (US); Jack Leahy, Berkley Heights, NJ (US)

( * ) Notice: Subject to any disclaimer, the term of this patent is extended or adjusted under 35 U.S.C. 154(b) by 567 days.

(21) Appl. No.: 11/774,527

(22) Filed: Jul. 6, 2007

(51) Int. Cl.
*E04G 3/28* (2006.01)

(52) U.S. Cl. ..... 182/146; 182/82; 182/136

(58) Field of Classification Search ..... 182/82, 182/146, 136
See application file for complete search history.

(56) References Cited

U.S. PATENT DOCUMENTS

| | | | | | |
|---|---|---|---|---|---|
| 2,500,636 | A * | 3/1950 | Isakson | 403/169 |
| 2,805,902 | A * | 9/1957 | Von Drasek et al. | 182/82 |
| 2,882,101 | A * | 4/1959 | Michalak et al. | 248/235 |
| 3,223,370 | A * | 12/1965 | Pignon | 248/214 |
| 4,160,350 | A * | 7/1979 | Craib | 52/696 |
| 4,308,934 | A * | 1/1982 | Jackson et al. | 182/182.4 |
| 4,340,130 | A * | 7/1982 | Payne et al. | 182/186.9 |
| 4,499,967 | A * | 2/1985 | Anderson | 182/222 |
| 4,598,794 | A * | 7/1986 | Anderson | 182/113 |
| 4,910,934 | A * | 3/1990 | Hennings | 52/714 |
| 4,984,654 | A * | 1/1991 | Anderson | 182/186.7 |
| 4,984,759 | A * | 1/1991 | Perlant | 248/99 |
| 5,016,735 | A | 5/1991 | Hodge | |
| 5,020,634 | A * | 6/1991 | Gunderson et al. | 182/182.4 |
| 5,307,603 | A * | 5/1994 | Chiodo | 52/698 |
| 5,488,810 | A * | 2/1996 | Horton | 52/715 |
| 5,575,130 | A * | 11/1996 | Chiodo | 52/713 |
| 6,354,402 | B1 * | 3/2002 | Masino | 182/222 |
| 6,354,758 | B1 * | 3/2002 | Chaulk | 403/102 |
| 6,467,745 | B1 * | 10/2002 | Sickels | 248/242 |
| 6,540,432 | B2 * | 4/2003 | Albanese | 403/388 |
| 6,886,662 | B2 * | 5/2005 | Riley | 182/82 |
| 6,912,819 | B2 * | 7/2005 | Price et al. | 52/285.3 |
| 2002/0050422 | A1 * | 5/2002 | Wymann | 182/82 |
| 2004/0007423 | A1 * | 1/2004 | Scott | 182/82 |
| 2005/0006174 | A1 * | 1/2005 | Terzini | 182/92 |

* cited by examiner

*Primary Examiner* — Katherine w Mitchell
*Assistant Examiner* — Candace L Bradford
(74) *Attorney, Agent, or Firm* — Crossley Patent Law

(57) ABSTRACT

A safety jack plate, which is a plate assembly that can be used in conjunction with standard pump jacks with standard scaffolding is used by contractors. Each safety jack plate includes a flat plate, a pair of end pieces attached to the flat plate, a pair of cutouts on each end piece so that each end piece can be mounted over the rails of a jack, and ridged surface on the flat plate and each of the end pieces.

5 Claims, 3 Drawing Sheets

FIG. 1
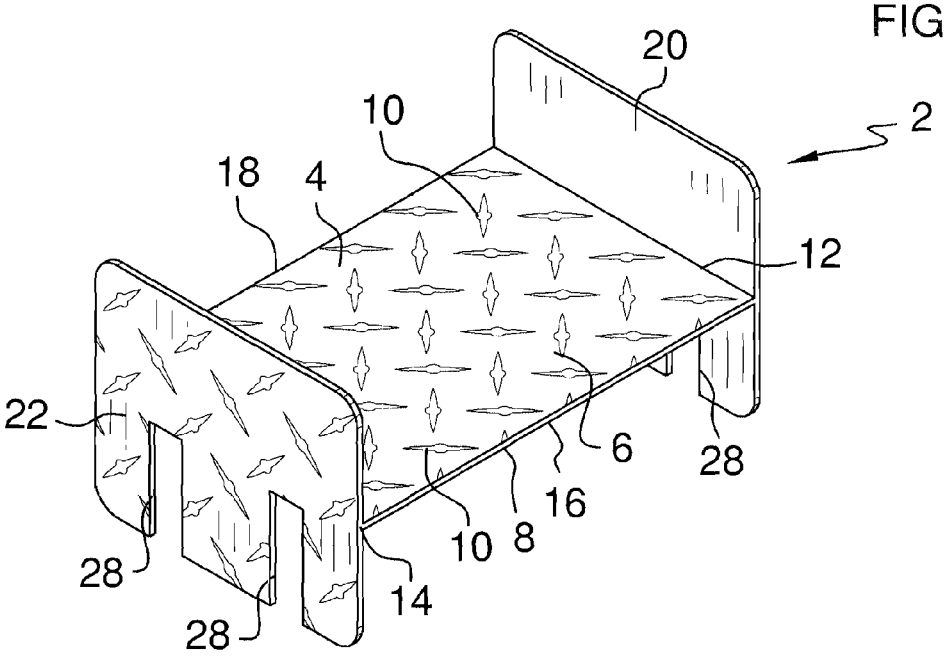
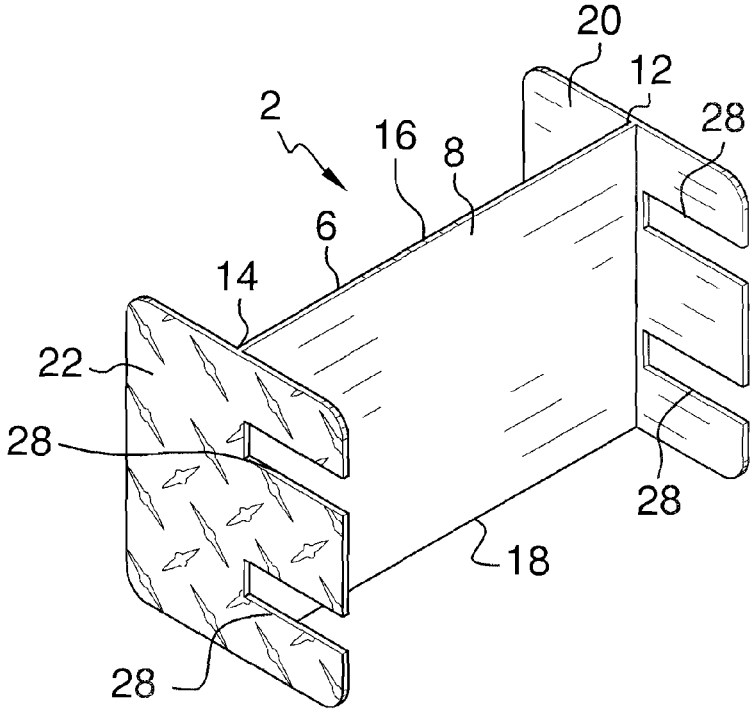
FIG. 2

SAFETY JACK PLATE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

The present invention concerns that of a new and improved safety jack plate, which is a plate assembly that can be used in conjunction with standard pump jacks with standard scaffolding is used by contractors.

DESCRIPTION OF THE PRIOR ART

U.S. Pat. No. 5,016,735, issued to Hodge, discloses a connector for maintaining the floor elements of a scaffold in a fixed spaced relation.

U.S. Pat. No. 6,354,402 B1, issued to Masino, discloses a platform assembly that utilizes a substantial number of inverted U-shaped vertical supports with platform hold down members that hold the platform in place.

U.S. Pat. No. 4,598,794, issued to Anderson, discloses a side rail system for interconnecting layered sections of elongated scaffold staging with the sections respectively spanning pairs of opposing upper and lower support arms of pump jacks which respectively ride on spaced apart jump jack poles.

U.S. Pat. No. 4,984,654, issued to Anderson, discloses a coupling arrangement for coupling a guard post to a scaffold platform.

U.S. Pat. No. 3,223,370, issued to Pignon, discloses plank support bracket adapted to be used in conjunction with construction scaffolding and the planking supported thereby.

SUMMARY OF THE INVENTION

The present invention concerns that of a new and improved safety jack plate, which is a plate assembly that can be used in conjunction with standard pump jacks with standard scaffolding is used by contractors. Each safety jack plate includes a flat plate, a pair of end pieces attached to the flat plate, a pair of cutouts on each end piece so that each end piece can be mounted over the rails of a jack, and ridged surface on the flat plate and each of the end pieces.

There has thus been outlined, rather broadly, the more important features of a safety jack plate that the detailed description thereof that follows may be better understood and in order that the present contribution to the art may be better appreciated. There are, of course, additional features of the safety jack plate that will be described hereinafter and which will form the subject matter of the claims appended hereto.

In this respect, before explaining at least one embodiment of the safety jack plate in detail, it is to be understood that the safety jack plate is not limited in its application to the details of construction and to the arrangements of the components set forth in the following description or illustrated in the drawings. The safety jack plate is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present safety jack plate. It is important, therefore, that the claims be regarded as including such equivalent constructions insofar as they do not depart from the spirit and scope of the present invention.

It is therefore an object of the present invention to provide a safety jack plate which has all of the advantages of the prior art and none of the disadvantages.

It is another object of the present invention to provide a safety jack plate which may be easily and efficiently manufactured and marketed.

It is another object of the present invention to provide a safety jack plate which is of durable and reliable construction.

It is yet another object of the present invention to provide a safety jack plate which is economically affordable and available for relevant market segment of the purchasing public.

Other objects, features and advantages of the present invention will become more readily apparent from the following detailed description of the preferred embodiment when considered with the attached drawings and appended claims.

BRIEF DESCRIPTION OF THE DRAWINGS

FIG. 1 shows a top perspective view of the safety jack plate.

FIG. 2 shows a side perspective view of the safety jack plate.

DESCRIPTION OF THE PREFERRED EMBODIMENT

Figure 3:
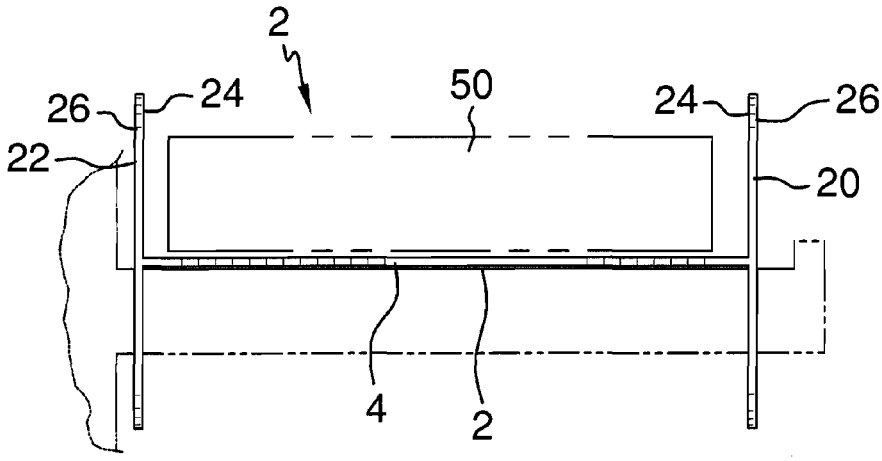
FIG. 3 shows a side view of the safety jack plate as it would appear in use mounted on a pump jack.
Figure 4:
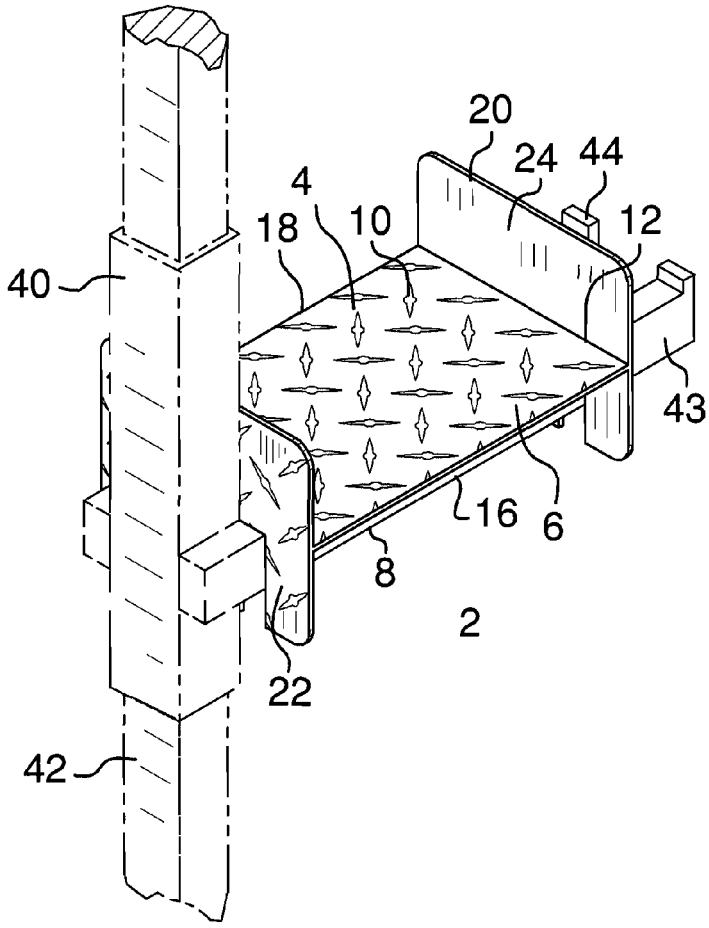
FIG. 4 shows a perspective view of the safety jack plate as it would appear in use mounted on a pump jack.
Figure 5:
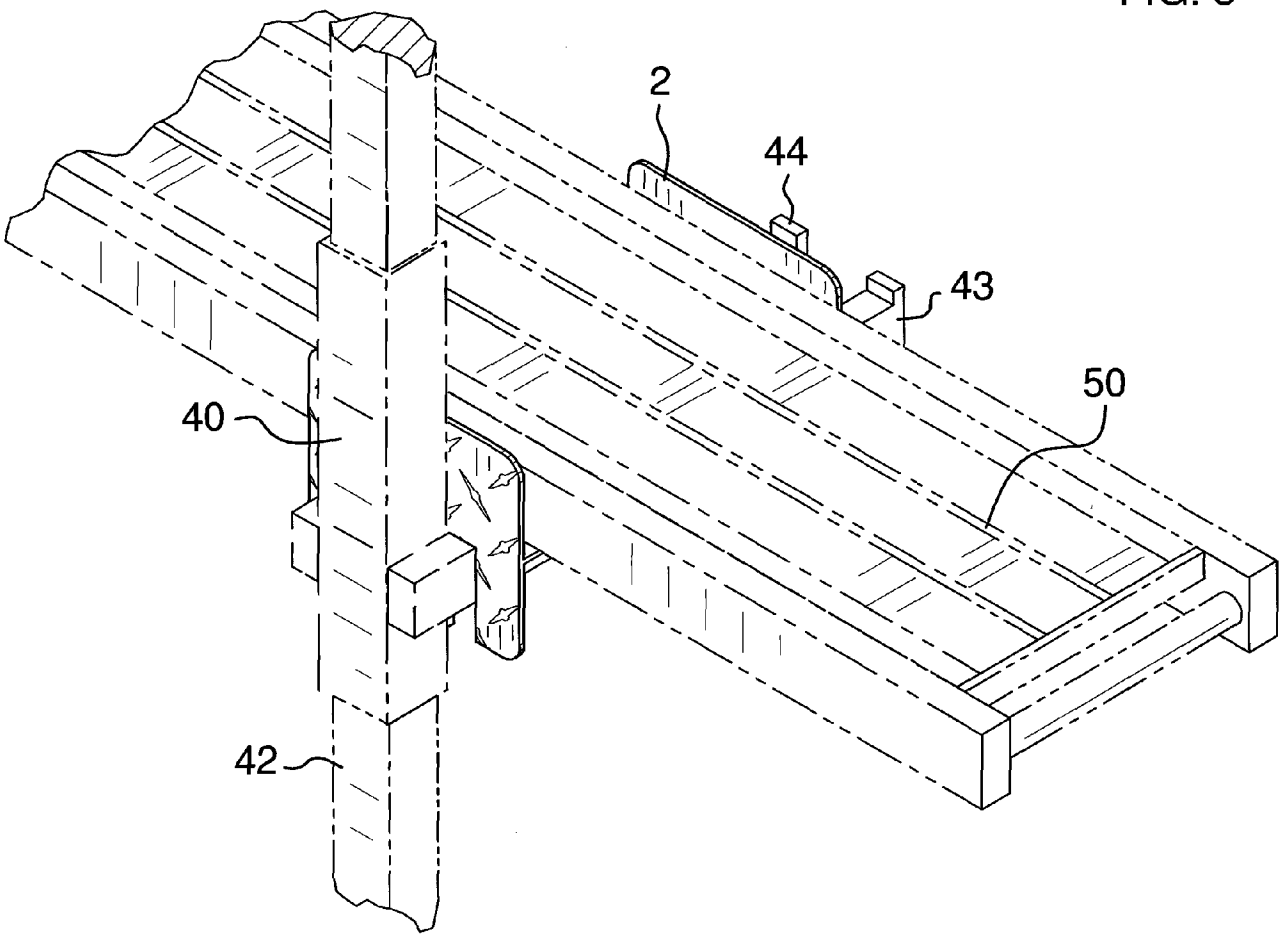
FIG. 5 shows a perspective view of the safety jack plate as it would appear in use mounted on a pump jack, with a piece of scaffolding attached to the pump jack.

With reference now to the drawings, and in particular to FIGS. 1 through 5 thereof, a new safety jack plate embodying the principles and concepts of the present invention and generally designated by the reference numeral 2 will be described.

As best illustrated in FIGS. 1 through 5, the safety jack plate 2 comprises a base plate 4 that has two surfaces comprising a top surface 6 and a bottom surface 8. The base plate preferably has a rectangular shape and has a length and a width, with the width having one of three preferably sizes: 12 inches, 18 inches, or 24 inches in width. The base plate 4 preferably has a plurality of ridges 10 on its top surface 6, which provides extra traction and gripping power for any item placed on the top surface 6 of the base plate 4.

The base plate 4 also has two ends comprising first end 12 and a second end 14, and furthermore, has two sides comprising a first side 16 and a second side 18.

The safety jack plate 2 further comprises a pair of end pieces comprising a first end piece 20 and a second end piece 22. The first end piece 20 is attached to the first end 12 of the base plate 4, while the second end piece 22 is attached to the second end 14 of the base plate 4. Approximately half of each end piece is located above the level of the base plate 4, while approximately half of each end piece is located below the level of the base plate 4.

Each of the end pieces has two surfaces comprising an inner surface 24 and an outer surface 26. The outer surface of each end piece has a plurality of ridges 10 on it, with these ridges 10 providing extra traction and gripping power for any item placed on the top surface 6 of the base plate 4.

Each end piece further comprises a pair of notches 28 disposed in a position parallel to each other, with each of the notches being located on the area of the respective end piece 20, 22 that is below the level of the base plate 4. Each notch 28 has a rectangularly-shaped cutout shape, and furthermore, each of the notches 28 on a particular end piece has the same orientation as the other notch 28 on that same particular end piece. The pair of notches 28 disposed on each end piece are configured to secure the safety jack plate 2 base plate 4 and the end pieces 20, 22 to a pump jack 40.

In use, the safety jack plate 2 would be used with a pump jack 40 that is mounted on a post 42. The pump jack 40, as parts of its configuration, would have a pair of rails 43 and 44 that extend outward from the pump jack 40. The rails 43 and 44 are configured in such a manner that allows the notches 28 on each of the end pieces to be mounted on top of the notches 28 on both of the end pieces.

The rails 42 and 44, in each instance, are longer than the length of the base plate 4. Therefore, the base plate 4, once placed over the pump jack 40, is essentially mounted on the pump jack 40 and furthermore, effectively "locked in" to position as the rails 42 and 44 tend to fall within the notches 28 that are present in each of the end pieces.

After this, a plank 50 can be placed over two or more successive pump jacks 40 in order to properly mount the plank 50. Once this occurs, an individual can utilize the plank 50 for walking and other closely related scaffolding needs and services.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A safety jack plate in combination with a pump jack, the safety jack plate comprising (a) a base plate, the base plate having two surfaces comprising a top surface and a bottom surface, the base plate further comprising two ends comprising a first end and a second end; the base plate further comprising two sides comprising a first side and a second side, wherein the base plate has a length, further wherein the base plate has a rectangular shape;

(b) a pair of end pieces comprising a first end piece and a second end piece; wherein each end piece comprises two surfaces comprising an inner surface and an outer surface; wherein the first end piece is attached to the first end of the base plate further wherein the second end piece is attached to the second end of the base plate; further wherein one-half of each end piece is located above a midpoint of the base plate, and further wherein the other one-half of each end piece is located below a midpoint of the base plate;

(c) a plurality of ridges, said ridges being attached to the top surface of the base plate, wherein the ridges reduce friction for items coming into contact with the base plate;

(d) a pair of rails extending outward horizontally from the pump jack, a pair of notches disposed in a position parallel position to each other on each end piece, said pair of notches being located in the one-half portion of the end piece that is located below the base plate, wherein the base plate is placed over the pair of rails such that the pair of notches vertically disposed on each end piece are placed over the pair of rails, effectively locking in the base plate, wherein each notch disposed on an end piece has a rectangularly-shaped cutout shape, each notch having an open bottom end, further wherein each of the notches on a particular end piece has the same orientation as the other notch on that same particular end piece wherein the notches are configured to secure the safety jack base plate and the end pieces to a pump jack.

2. A safety jack plate in combination with a pump jack according to claim 1 wherein the safety jack plate is in combination with a plank, wherein the plank is placed over at least two successive pump jacks.

3. A safety jack plate in combination with a pump jack according to claim 2 wherein the base plate has a width of twelve (12) inches.

4. A safety jack plate in combination with a pump jack according to claim 2 wherein the base plate has a width of eighteen (18) inches.

5. A safety jack plate in combination with a pump jack according to claim 2 wherein the base plate has a width of twenty-four (24) inches.

* * * * *